United States Patent [19]

Chance

[11] Patent Number: 4,483,083

[45] Date of Patent: Nov. 20, 1984

[54] DRYING AND RUNNABILITY FOR HIGH SPEED PAPER MACHINES

[75] Inventor: James L. Chance, Rockton, Ill.

[73] Assignee: Beloit Corporation, Beloit, Wis.

[21] Appl. No.: 409,154

[22] Filed: Aug. 18, 1982

[51] Int. Cl.[3] ..... F26B 13/08

[52] U.S. Cl. ..... 34/113; 34/116

[58] Field of Search ..... 34/113, 115, 116

[56] References Cited

U.S. PATENT DOCUMENTS

| | | | |
|---|---|---|---|
| 191,997 | 6/1877 | Ostermoor . | |
| 340,335 | 4/1886 | Lindsay . | |
| 571,787 | 11/1896 | Paul et al. . | |
| 705,606 | 7/1902 | Paul et al. . | |
| 3,303,576 | 2/1967 | Sisson | 34/116 |
| 3,503,139 | 3/1970 | Mahoney | 34/111 |
| 3,868,780 | 3/1975 | Soininen et al. | 34/116 |
| 4,202,113 | 5/1980 | Kankaanpaa | 34/116 |

*Primary Examiner*—Larry I. Schwartz

*Attorney, Agent, or Firm*—Hill, Van Santen, Steadman & Simpson

[57] ABSTRACT

A dryer for a papermaking machine including a first heated dryer drum with a second heated dryer drum above the first drum and a turning roll positioned between the first and second drums with a carrying felt threaded over the drums and turning roll with a web being between the drum and felt on each of the drums and on the outer surface of the felt over the roll, with successive third and fourth drums after the first and second drums, with the fourth drum below the third and a turning roll positioned between the third and fourth drums with the web again being directly in contact with the third and fourth drums and on the outside of the felt on the turning roll.

12 Claims, 3 Drawing Figures

DRYING AND RUNNABILITY FOR HIGH SPEED PAPER MACHINES

BACKGROUND OF THE INVENTION

The invention relates to improvements in papermaking machines, and more particularly to improvements in a dryer section for drying a traveling fibrous web such as in a papermaking machine for improved handling of the web and improved drying.

In present high speed papermaking machines with improved formation and improved pressing, the web can be formed faster and better, particularly with the new generation of twin wire formers so that the wet end is no longer the limiting constraint to reaching higher productions. Therefore, the demand is increased for improvements in the dryer section of the papermaking machine to accommodate higher speeds. A primary limitation on lightweight grades, such as newsprint, is sheet flutter in the dryer section. At the beginning of the dryer section during the early stages of drying when the web contains more moisture and is still very fragile, it becomes slack and cross-machine tension variations cause wrinkles in the sheet. Disturbances in web travel can cause the sheet to fold over upon itself resulting in the formation of machine direction wrinkles. Most of these wrinkles occur near the front or back edges of the sheet and may vary in size from a few inches to several feet in length. In order to minimize slackness in the web and the resultant susceptibility to wrinkling, the draws can be tightened. This results in less fold-overs and less wrinkling, but it is done at the expense of increased wet and dryer sheet breaks.

In developments in improved dryer sections, one arrangement has involved a felt run known in the art as a "uno-run" or "single felt run" which has been installed on many machines producing lightweight grades. The uno-run is a dryer felt arrangement where a single felt is utilized to wrap both top and bottom dryers used usually only in the first dryer section. The paper web is then sandwiched between the felt and cylinder on the top dryer drums and travels on the outside of the felt as it goes around the bottom dryer drums. The purpose of this arrangement is to stabilize the sheet from edge fluttering and billowing while the web is weak and prone to breaks. However, a primary drawback of the single felting arrangement stems from the large loss of drying which results on the bottom cylinders where the web is on the outer surface of the felt and the felt, therefore, acts as an insulator and prevents effective heat transfer to the sheet.

An important object of the present invention is to provide an improved dryer section utilizing a single felt run, but avoiding the disadvantages of loss of drying when the sheet is carried on the outer surface of the felt over the drum and retaining good runnability which is associated with single felting and with the benefit of no drying loss on the bottom drums.

In accordance with the principles of the present invention, the traveling web or sheet enters on a small dryer or a baby dryer roll, travels around a second drum on the outside of the felt for heat conditioning, and is then sandwiched between the felt and cylinder on the No. 3 dryer drum which is above the No. 2 drum. The sheet is then conveyed on the felt through a series of substantially spaced stacks of drums, the drums being in vertical alignment in the stacks and being arranged so that the sheet is in direct contact with the drum surface on both the upper drum and the lower drum in each stack. To accomplish this, a turning roll is positioned between the drums which may be preferably in the form of a vacuum roll or a grooved felt roll, and arrangements are made with turning rolls positioned to obtain a wrap around the top and bottom rolls with the felt and sheet traveling directly across the spans from stack to stack.

With this arrangement, there are no open draws in the dryer driver group, and the web or sheet is always supported by the felt. With the exception of the advantageous arrangement wherein the sheet rides on the outer surface of the felt on the first bottom dryer roll, the sheet is always sandwiched between the felt and cylinder. There, therefore, is no loss in drying as is encountered with conventional single felt dryers where the sheet travels on the outside of the felt on the bottom dryer drums. Also, because of the large felt and sheet wrap angles, drying rates should be higher than on conventional dryers. Other advantages include more positive threading when the turning rolls are vacuum rolls. Also, the arrangement provides for self-dumping for all sheet runs. The arrangement accommodates any convenient height for the different dryer sections and as many vertically arranged drums can be utilized as are desired and as are accommodated by the mill overhead structure. The web is continuously controlled to eliminate flutter, and improved results from the relatively open relation between the roll stacks and providing for good moisture evaporation are obtained.

Other objects and advantages and features will become more apparent with the teaching of the principles of the present invention in connection with the disclosure of the preferred embodiments thereof in the specification, claims and drawings, in which:

DESCRIPTION

Figure 1:
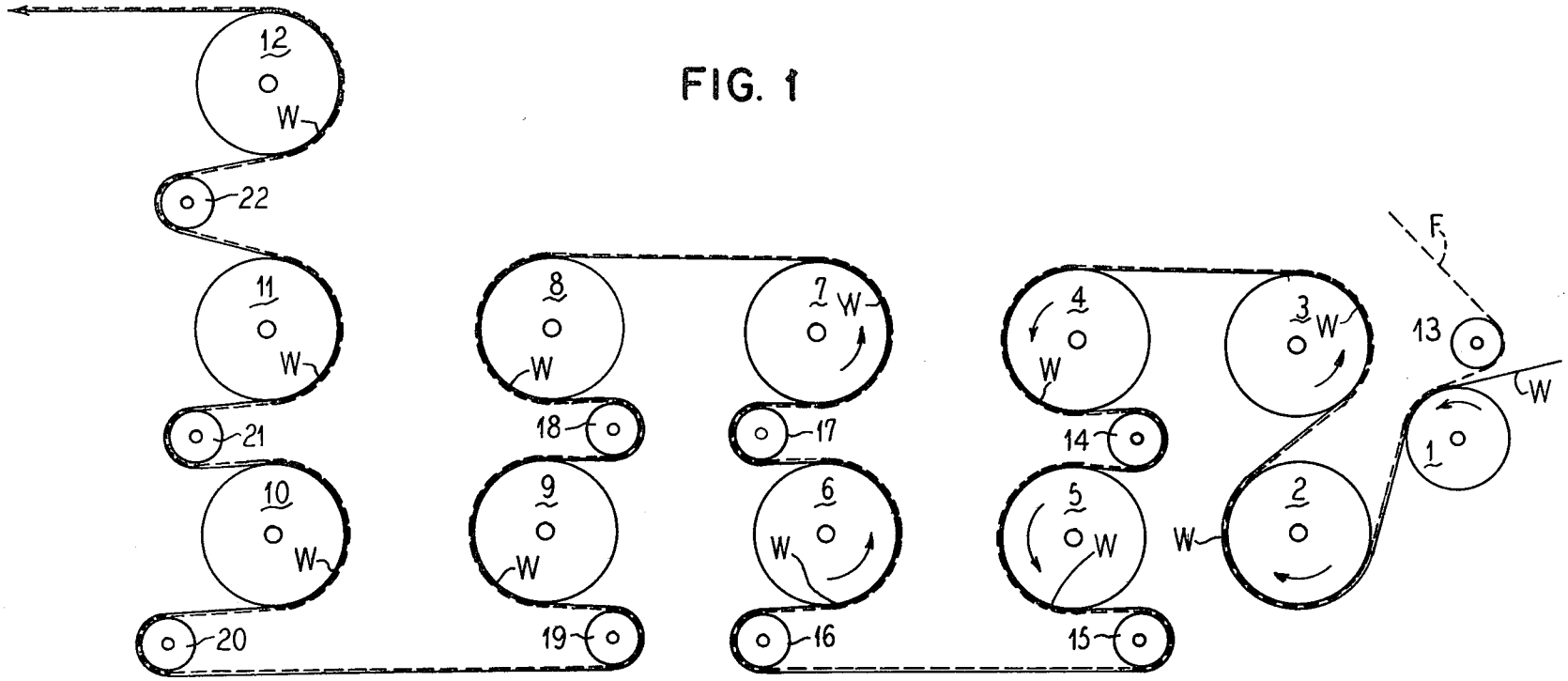
FIG. 1 is a somewhat schematic elevational view showing a dryer section embodying the principles of the present invention.

As illustrated in FIG. 1, the web W, shown in solid line, enters the dryer section from the press section of a papermaking machine and passes over the surface of a heated, small diameter baby dryer drum 1. The web is in direct contact with the surface of this small drum, and a traveling felt F picks up the web on the drum 1 and thereafter carries it and accompanies it through the entire drying section so that there are no unsupported draws.

In the drawing, the sequence of heated dryer rolls or drums is numbered 1 through 12. The sequence of turning rolls is numbered 13 through 22.

The heated dryer drums are of conventional structure having a smooth cylindrical outer surface for transmitting heat to the web with the outer surface being highly polished or provided with a nonstick material. The dryer drums are suitably heated such as by steam for evaporating moisture from the web, and are rotationally carried on suitable end bearings with drives, and these structural details will be fully understood by those versed in the art and need not be further described or shown in detail.

After the web felt F has been guided by the roll 13 into wrapping corelation with the web as it passes over the baby small diameter dryer drum 1, the web W is carried by the felt F, shown in broken line, from the drum 1 to and in wrapping relation onto and over a second larger diameter dryer drum 2 on the outer surface of the felt thus conditioning the web and gradually increasing the temperature of the moisture therein and the heat of the drum 2 being transferred through the felt to the web. Following the drum 2, the web thereafter wraps and is in direcct surface contact with each of the succeeding drums 3 through 12. Dryer drum 3 is positioned above drum 2, and the web and felt reverse slightly in direction so as to pass over the top surface of the drum 3, and effect at least 180° wrap of the felt and web about the drum 2. As shown, the drum 3 desirably has its axis of rotation substantially vertically above the axis of rotation of the drum 2. The arrowed lines indicate the direction of rotation of the heated dryer drums.

The web on the inner or under surface of the felt passes directly from drum 3 to 4 and wraps the outer surface of drum 4 for substantially 180 degrees.

A drum 5 is positioned directly below drum 4, and in passing from drum 4 to drum 5, the web and felt pass over a turning roll 14 which is positioned between the drum and slightly to the right of the stack so as to cause a wrap of essentially 180 degrees over the drums. Following the turning roll, the web on the inner surface of the felt passes over the lower drum 5 and in direct contact with the surface thereof, and a further turning roll 15 is aligned somewhat below the turning roll 14 so as to cause a full 180 degree wrap of the web over the drum 5.

Figure 2:
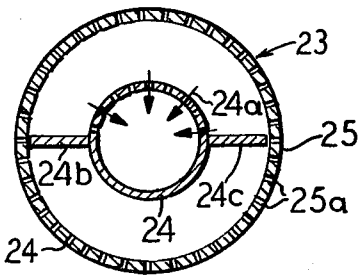
FIG. 2 is a somewhat schematic sectional view of a form of turning roll which may be used.

The turning rolls, may be plain rolls, grooved rolls or vacuum rolls, but preferably are such as are known as P-V rolls as shown in FIG. 2 at 23. This structure includes a stationary inner pipe 24 surrounded by an outer rotating cylinder 25. The pipe 24 has perforations so that one-half of the periphery provides for an inward flow of air as indicated by the arrowed lines 24*a*. A pair of diametrically opposed seals 24*b* and 24*c* extend between the pipe and the concentric cylinder 25 so that the vacuum is exposed to the upper half of the rotating cylinder 25. The P-V roll assemblies are positioned so that the vacuum portion of the cylinder faces the web as it passes over the turning rolls. The vacuum rolls hold the sheet tightly to the felt as it passes around rolls 14, 15, 16, 17, etc. A quantity of air is drawn into the roll at the ingoing nip of the felt and vacuum roll to prevent "pumping" (i.e., to prevent the sheet from being blown off at the ingoing nip). The effect of the roll is also to help flatten the web preventing wrinkles in the edges. Further, the flexure or bending of the web over a reverse curvature helps condition the fibers for better contact with the succeeding drum as when the web passes from the turning roll 14 down to the drum 5.

Figure 3:
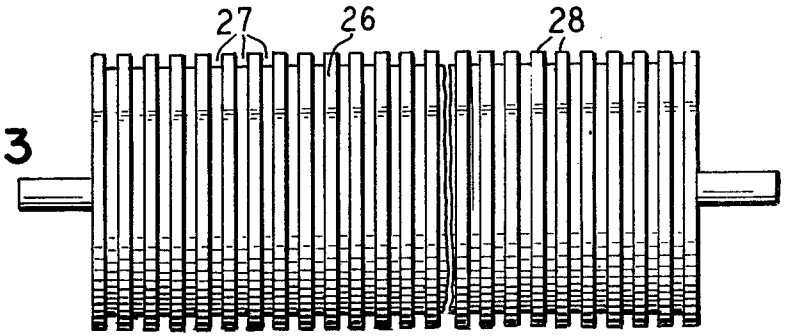
FIG. 3 is a fragmentary perspective view of another form or turning roll which may be used.

Another form of turning roll 26, illustrated in FIG. 3 is a roll which has a plurality of annular relatively shallow (i.e., about 3/16") grooves 27 with intermediate land areas 28 of about the same dimension. The effect of this roll is to aid in removing the wrinkles from the sheet, and the roll functions by providing a space (i.e., the annular shallow grooves) for the air traveling with the web, and the air escapes as the web wraps the turning roll. It may be desirable that the turning rolls in the first section of the machine be perforate rolls, also known to the trade as PV rolls, or grooved rolls, and the rolls later in the section may be plain rolls, or a combination of these types of rolls may be employed.

On the drum 5, the web is guided to be wrapped over the lower surface by the turning roll 15. The web carried on the felt then passes beneath the second vertical stack of drums, including drums 4 and 5 to the third stack of drums comprising drums 6 and 7. The web and felt pass over the turning roll 16 with the web on the outer surface of the turning roll, and then the web and felt wrap the drum 6 with the web in direct contact with the drum surface. Turning roll 17 is positioned between drums 6 and 7 so as to further condition the web and to cause the web to wrap 180 degrees of the drums. After the web and felt are wrapped over drum 7, they pass directly overhead to the fourth stack of drums, being threaded over drum 8.

Following drum 8, the web and felt are carried over turning roll 18 positioned between the drums 8 and 9 and then down over the drum 9 with the web in direct contact with the surface of the lower drum 9.

Turning roll 19 is positioned beneath the drum 9 so as to give a full wrap to the web, and the web and felt are then led laterally over turning roll 20. The web and felt then pass up over the fifth stack of drums comprising drums 10, 11 and 12. Between drums 10 and 11 is a turning roll 21, and between drums 11 and 12 is a turning roll 22, with the turning rolls positioned so as to give a full wrap to the web and felt. For each drum the web is in direct contact with the surface of the drum for optimum heat transfer. The fifth stack of drums illustrates that the number of drums used in any vertical stack is substantially limitless.

With this arrangement, the webs are in direct contact with the bottom dryer drums as well as the top. The open arrangement provides for good ventilation for rapidly carrying away the moisture and more effective drying.

The web is continually supported throughout the travel through this illustrated section of the dryer so that there are no open draws. The arrangement is compact in space and yet there is a large wrap angle provided for each contact between the web and dryer drum.

With the use of vacuum rolls as turning rolls, a positive threading is achieved because the web is continually supported on the inner surface of the felt in passage over all of the dryer drums, and when the web is carried on the outer surface and makes a reverse turn, it is held to the felt by the vacuum of the vacuum PV roll.

In the event of web breakage, the broke is self-dumping which is a substantial operating feature. The sheet is in direct contact with all dryer drums except the second bottom drums 2, and this provides for gentle warmup of the web and helps prevent picking.

Thus, it will be seen that I have provided an improved dry section which meets the objects and advantages above set forth, and various arrangements and modifications within the spirit and scope of the invention may be employed as encompassed by the foregoing disclosure.

I claim as my invention:

1. A dryer section for drying a traveling fibrous web such as in a papermaking machine, comprising in combination:

a first small diameter heated dryer roll receiving a web wrapping its surface in direct contact therewith for conditioning the web;

a second internally heated imperforate dryer roll of larger diameter;

a felt for passing through the dryer section receiving the web from said first roll and wrapping the second roll with the web on the outer surface of the felt for gradually heating the moisture in the web with heat of the second roll being transferred through the felt to the web;

and a plurality of succeeding dryer rolls receiving the felt and web for further drying with the web in direct contact with the succeeding rolls, and the felt carrying the web between rolls with no open draws.

2. A dryer section for drying a traveling fibrous web such as in a papermaking machine comprising, in combination:

a first small diameter heated dryer roll receiving a web wrapping its surface in direct contact therewith for conditioning the web;

a second internally heated imperforate dryer roll of larger diameter;

a felt for passing through the dryer section receiving the web from said first roll and wrapping the second roll with the web on the outer surface of the felt for gradually heating the moisture in the web with heat of the second roll being transferred through the felt to the web;

a third dryer roll positioned above the second roll with the felt and web wrapping the third roll and with the web on the inner surface of the felt in direct contact with the third roll;

a fourth roll positioned laterally opposite the third roll with the web and felt traveling directly from the third to the fourth roll and the web in direct contact with the fourth roll;

a fifth heated dryer roll beneath the fourth roll;

and a turning roll between the fourth and fifth rolls with the web wrapping the turning roll on the outer surface of the felt between the fourth and fifth dryer rolls.

3. A dryer section according to claim 1, wherein said succeeding dryer rolls include a third roll located above said second roll and causing said felt and web to lap at least 180° of said second roll.

4. A dryer section according to claim 3, wherein said third roll has an axis of rotation substantially vertically above an axis of rotation of said second roll.

5. A dryer section according to claim 2, wherein said third dryer roll has an axis of rotation substantially vertically above an axis of rotation of said second dryer roll for assuring that the felt and web will wrap said second roll over at least 180° of the perimeter of the second roll.

6. A dryer section for drying a traveling fibrous web such as in a papermaking machine, comprising in combination:

a first small diameter heated dryer roll receiving a web wrapping its surface in direct contact therewith for conditioning the web;

a second internally heated imperforate dryer roll of larger diameter;

a felt for passing through the dryer section receiving the web from said first roll and wrapping the second roll with the web on the outer surface of the felt for gradually heating the moisture in the web with heat of the second roll being transferred through the felt to the web;

and a plurality of succeeding dryer rolls receiving the felt and web for further drying with the web in direct contact with the succeeding rolls and the felt carrying the web between rolls with no open draws, and including a third roll located above said second roll and arranged to cause said felt and web to wrap at least 180° of said second roll.

7. A dryer section according to claim 6, wherein said third roll has an axis of rotation substantially vertically above an axis of rotation of said second roll.

8. A dryer section according to claim 6, wherein a turning roll is located above said first roll and is adapted for guiding said felt into engagement with said web on said first roll.

9. A dryer section for drying a traveling fibrous web such as in a papermaking machine, comprising in combination:

a first internally heated imperforate dryer drum;

a second internally heated imperforate dryer drum positioned beneath the first drum;

a first turning roll positioned between said first and second drums;

a carrier felt threaded over the top of the first drum to wrap the drum and then passing over the turning roll and then wrapping the second drum and carrying a web passing between the felt and the heated surfaces of said first and second drums and being in direct contact with the drum surfaces and threaded over the outside of the felt on the turning roll for being smoothed and conditioned thereon;

a third internally heated imperforate dryer drum positioned laterally in substantially spaced relation opposite the second drum;

a fourth internally heated inperforate dryer drum positioned above the third drum and laterally in substantially spaced relation opposite the first drum;

a second turning roll positioned beneath the second drum for leading the felt and web to wrap beneath the second drum;

a third turning roll positioned beneath the third drum for leading the felt and web from the second turning roll beneath the third drum with the web being carried on the outer surface of the felt in the span between, and in passing over, the second and third turning rolls;

a fourth turning roll positioned between said third and fourth internally heated imperforate dryer drums;

a fifth internally heated imperforate dryer drum positioned laterally in substantial spaced relation opposite the fourth drum;

a sixth internally heated imperforate dryer drum positioned beneath the fifth drum and laterally in substantially spaced relation opposite the third drum;

a fifth turning roll positioned between the fifth and sixth drums;

the web and felt wrapping said fourth and fifth drums and the web being carried by the felt passing across a span directly between the tops of the fourth drum and and the fifth drum without any intervening turning roll and thereafter wrapping the fifth and sixth drums with the web between the felt and the drums and with the felt and web passing over the fifth turning roll between the fifth and sixth drums.

10. A dryer section according to claim 9, including a small diameter heated dryer roll receiving said web wrapping its surface in direct contact therewith for conditioning the web and receiving said felt wrapping the web on the small diameter roll; a larger diameter internally heated imperforate dryer roll receiving the felt carrying the web from said small diameter roll and the felt wrapping the larger diameter roll with the web on the outer surface of the felt for gradually heating the moisture in the web with heat of the large diameter roll being transferred through the felt to the web; and another large diameter roll located above said first mentioned large diameter roll and located to receive the web in direct contact therewith and the felt on the outside of said second large diameter roll, and the second large diameter roll being located relative to the first mentioned roll to assure wrapping of the felt with the web on the outside over at least 180° of the perimeter of said first mentioned large diameter roll.

11. A dryer section according to claim 10, wherein said another large diameter roll has an axis of rotation substantially vertically above an axis of rotation of said first mentioned large diameter roll.

12. A dryer section for drying a traveling fibrous web such as in a papermaking machine, comprising in combination:

a first small diameter heated dryer roll receiving a web wrapping its surface in direct contact therewith for conditioning the web;

a second internally heated imperforate dryer roll of larger diameter;

a felt for passing through a dryer section receiving the web from said first roll and wrapping the second roll with the web on the outer surface of the felt for gradually heating the moisture in the web with heat of the second roll being transferred through the felt to the web;

a plurality of succeeding dryer rolls receiving the felt and web for further drying with the web in direct contact with the succeeding rolls and the felt carrying the web between rolls with no open draws, and including a third roll located above said second roll and arranged to cause said felt and web to wrap at least 180° of said second roll;

said third roll having an axis of rotation substantially vertically above an axis of rotation of said second roll;

and a turning roll positioned above and upstream from the onrunning side of said web onto said small diameter heated dryer roll and operating to guide said felt toward said web substantially at the point of engagement of the web with said first dryer roll.

* * * * *

UNITED STATES PATENT AND TRADEMARK OFFICE

CERTIFICATE OF CORRECTION

PATENT NO. : 4,483,083

DATED : November 20, 1984

INVENTOR(S) : James L. Chance

It is certified that error appears in the above-identified patent and that said Letters Patent are hereby corrected as shown below:

Column 7, line 2, change the word "larger" to --large--.

Signed and Sealed this

*Ninth* Day of *April 1985*

[SEAL]

*Attest:*

DONALD J. QUIGG

*Attesting Officer*

*Acting Commissioner of Patents and Trademarks*